US006017865A

United States Patent [19]

Hartshorn et al.

[11] Patent Number: 6,017,865

[45] Date of Patent: Jan. 25, 2000

[54] PERFUME LAUNDRY DETERGENT COMPOSITIONS WHICH COMPRISE A HYDROPHOBIC BLEACHING SYSTEM

[75] Inventors: Richard Timothy Hartshorn; Youssef Oubrahim, both of Newcastle upon Tyne; Allan Campbell McRitchie; Christiaan Arthur Jacques Kamiel Thoen, both of Tyne & Wear, all of United Kingdom

[73] Assignee: The Procter & Gamble Company, Cincinnati, Ohio

[ * ] Notice: This patent issued on a continued prosecution application filed under 37 CFR 1.53(d), and is subject to the twenty year patent term provisions of 35 U.S.C. 154(a)(2).

[21] Appl. No.: 09/077,504

[22] PCT Filed: Nov. 22, 1996

[86] PCT No.: PCT/US96/18673

§ 371 Date: Jun. 2, 1998

§ 102(e) Date: Jun. 2, 1998

[87] PCT Pub. No.: WO97/20911

PCT Pub. Date: Jun. 12, 1997

[30] Foreign Application Priority Data

Dec. 6, 1995 [EP] European Pat. Off. ..... 95308818

[51] Int. Cl.[7] ..... C11D 3/50; C11D 7/54

[52] U.S. Cl. ..... 510/313; 510/101; 510/309; 510/310; 510/312; 510/469

[58] Field of Search ..... 510/101, 102, 510/309, 310, 312, 313, 375, 376, 469

[56] References Cited

U.S. PATENT DOCUMENTS

| | | | |
|---|---|---|---|
| H1468 | 8/1995 | Costa et al. | 252/174.12 |
| 3,959,168 | 5/1976 | Germscheid et al. | 252/180 |
| 4,391,724 | 7/1983 | Bacon | 510/513 |
| 4,391,725 | 7/1983 | Bossu | 510/297 |
| 4,412,934 | 11/1983 | Chung et al. | 252/186.38 |
| 4,483,781 | 11/1984 | Hartman | 510/374 |
| 4,536,314 | 8/1985 | Hardy et al. | 510/376 |
| 4,619,779 | 10/1986 | Hardy | 510/513 |
| 4,634,551 | 1/1987 | Burns et al. | 510/313 |
| 4,663,068 | 5/1987 | Hagemann et al. | 510/102 |
| 4,681,592 | 7/1987 | Hardy et al. | 8/111 |
| 4,923,631 | 5/1990 | Sims et al. | 252/186.42 |
| 5,021,182 | 6/1991 | Jentsch | 510/306 |
| 5,091,106 | 2/1992 | Jacobs et al. | 510/310 |
| 5,248,434 | 9/1993 | Nicholson | 252/186.42 |
| 5,264,143 | 11/1993 | Boutique | 510/303 |
| 5,405,412 | 4/1995 | Willey et al. | 8/111 |
| 5,500,153 | 3/1996 | Figueroa et al. | 510/292 |
| 5,677,272 | 10/1997 | Ghosh et al. | 510/306 |
| 5,691,303 | 11/1997 | Pan et al. | 512/4 |
| 5,801,137 | 9/1998 | Addison et al. | 510/228 |

FOREIGN PATENT DOCUMENTS

| | | |
|---|---|---|
| 133354 | 2/1985 | European Pat. Off. . |
| 214789 | 3/1987 | European Pat. Off. . |
| 332259 | 9/1989 | European Pat. Off. . |

OTHER PUBLICATIONS

CAPLUS Abstract of EP 170,386, Feb. 1986.

*Primary Examiner*—Caroline D. Liott
*Attorney, Agent, or Firm*—C. Brant Cook; K. W. Zerby; J. C. Rasser

[57] ABSTRACT

The present invention relates to detergent compositions comprising: a) a hydrophobic bleaching system selected from i) hydrogen peroxide or a source thereof in amount of from 0.1% to 60% by weight and combined with a hydrophobic peroxyacid bleach precursor in amount of from 0.1% to 60% by weight, ii) a preformed hydrophobic peroxyacid in amount of from 0.1% to 60% by weight, and iii) mixtures of i) and ii), wherein a hydrophobic peroxyacid bleach precursor is defined as a compound which produces under perhydrolysis a hydrophobic peroxyacid whose parent carboxylic acid has a critical micelle concentration less than 0.5 moles/liter measured in aqueous solution at 25° C. and pH 7, and wherein a hydrophobic preformed peroxyacid is defined as a compound whose parent carboxylic acid has a critical micelle concentration less than 0.5 moles/liter measured in aqueous solution at 25° C. and pH 7; b) up to 5% by weight of a perfume composition; and c) at least 0.6% by weight of a metal ion sequestrant selected from aminocarboxylate compounds, aminophosphonates and mixtures thereof. The said compositions provide effective cleaning of fabrics without being detrimental to the perfume composition deposited on the fabrics.

17 Claims, No Drawings

PERFUME LAUNDRY DETERGENT COMPOSITIONS WHICH COMPRISE A HYDROPHOBIC BLEACHING SYSTEM

FIELD OF THE INVENTION

The present invention relates to detergent compositions comprising a bleaching system and a perfume composition for providing an effective cleaning of soiled fabrics together with an effective residual perfume scent on the laundered fabrics.

BACKGROUND OF THE INVENTION

The satisfactory removal of dingy stains from soiled/stained substrates is a particular challenge to the formulator of a detergent composition, which has been enabled by the use of bleach components of hydrophobic type such as preformed hydrophobic peroxyacids or hydrogen peroxide and hydrophobic peroxyacid precursors.

However, consumer acceptance of cleaning and laundry products is determined not only by the performance achieved with these products but the aesthetics associated therewith. The perfume systems are therefore an important aspect of the successful formulation of such commercial products.

They are used to cover up the chemical odours of the cleaning ingredients and provide an aesthetic benefit to the wash process and, preferably the cleaned fabrics.

It has now been found that a problem encountered with detergent compositions comprising the combination of a hydrophobic bleach system and a perfume composition is that of the resulting laundered fabric having a "bleachy" characteristic odour.

Not to be bound by theory, it is believed that the hydrophobic bleach system which is a substantive bleach interacts with the perfume deposited on the fabric surface by degrading said perfume.

The potential for such a problem is enhanced when the detergent composition comprises a high level of surfactants, said problem being due to the ability of surfactants, especially anionic surfactants, to transport the hydrophobic bleaching agent to the fabric surface.

The Applicant has found that the degradation of the perfume at the fabric surface can be a particular problem when the fabric to be cleaned has already build up of encrustated metal ions present. This problem can also further be exarcerbated upon use of a detergent composition having a low builder content and/or of a hard water medium.

The detergent formulator is thus faced with the dual challenge of formulating a product which maximises the soil/stain removal performance without compromising on the aesthetic aspect.

Co-pending application GB 9425876.1 describes perfume raw materials in presence of a hydrophobic bleaching system wherein the source of active oxygen is coated to prevent the oxidation of said perfume raw materials upon storage.

Co-pending application GB 9505518.2 describes detergent compositions comprising perfume raw materials having a strong resistance to oxidation from hydrophobic bleaches.

WO 95/02681 describes sensitive materials such as chelating agents (EDDS), perfume components or hydrophobic bleaches protected from oxidative environment by a specific package.

It is further known to the man skilled in the art that perfumes are composed of volatile ingredients which are susceptible of oxidation upon storage. Accordingly, the perfume composition may be protected from the oxidative environment by encapsulation of the perfume with silica material as described in EP 332259 or adsorption onto porous carrier as disclosed in UK 2,066,839, U.S. Pat. Nos. 4,539,135; 4,713,193, 4,304,675, WO 94/19449 and WO 94/28107. Although efficient to protect the perfume from oxidation upon storage and/or to direct the perfume to the fabric, these materials will still release or leach the perfume out of the material upon wash, exposing thus the perfume to the bleach component at the fabric surface.

Notwithstanding the advance in the art there is still a need for a detergent composition which provide effective soil/stain removal performance together with an effective residual perfume scent on laundered fabrics.

The Applicant has now found that this problem can be overcome by the provision of a metal ion sequestrant present at high levels within the detergent composition.

The further addition of an organodiphosphonic component has been found to be beneficial to the overall performance of the detergent composition.

SUMMARY OF THE INVENTION

The present relates to a detergent composition comprising: a)-a hydrophobic bleaching system selected from i)- hydrogen peroxide or a source thereof in amount of from 0.1% to 60% by weight and combined with a hydrophobic peroxyacid bleach precursor in amount of from 0.1% to 60% by weight, ii)-a preformed hydrophobic peroxyacid in amount of from 0.1% to 60% by weight, and iii) mixtures of i) and ii), wherein a hydrophobic peroxyacid bleach precursor is defined as a compound which produces under perhydrolysis a hydrophobic peroxyacid whose parent carboxylic acid has a critical micelle concentration less than 0.5 moles/liter measured in aqueous solution at 25° C. and pH 7, and wherein a hydrophobic preformed peroxyacid is defined as a compound whose parent carboxylic acid has a critical micelle concentration less than 0.5 moles/liter measured in aqueous solution at 25° C. and pH 7, b)-up to 5% by weight of a perfume composition, and c)-at least 0.6% by weight of a metal ion sequestrant selected from aminocarboxylate compounds, aminophosphonates and mixtures thereof.

In a preferred embodiment, the present invention further comprises an organo diphosphonic compound.

DETAILED DESCRIPTION OF THE INVENTION

Hydrophobic Bleach System

An essential component of the invention is a hydrophobic bleach system selected from hydrogen peroxide or a source thereof combined with a hydrophobic peroxyacid bleach precursor, a preformed hydrophobic peroxyacid and any mixtures thereof. Preferred sources of hydrogen peroxide include perhydrate bleaches.

Perhydrate Bleach

The perhydrate is typically an inorganic perhydrate bleach, normally in the form of the sodium salt, as the source of alkaline hydrogen peroxide in the wash liquor. This perhydrate is normally incorporated at a level of from 0.1% to 60%, preferably from 3% to 40% by weight, more preferably from 5% to 35% by weight and most preferably from 8% to 30% by weight of the composition.

The perhydrate may be any of the alkalimetal inorganic salts such as perborate monohydrate or tetrahydrate, percarbonate, perphosphate and persilicate salts but is conventionally an alkali metal perborate or percarbonate.

Sodium percarbonate, which is the preferred perhydrate, is an addition compound having a formula corresponding to 2Na2CO3.3H202, and is available commercially as a crystalline solid. Most commercially available material includes a low level of a heavy metal sequestrant such as EDTA, 1-hydroxyethylidene 1,1-diphosphonic acid (HEDP) or an amino-phosphonate, that is incorporated during the manufacturing process. For the purposes of the detergent composition aspect of the present invention, the percarbonate can be incorporated into detergent compositions without additional protection, but preferred executions of such compositions utilise a coated form of the material. A variety of coatings can be used including borate, boric acid and citrate or sodium silicate of SiO2:Na2O ratio from 1.6:1 to 3.4:1, preferably 2.8:1, applied as an aqueous solution to give a level of from 2% to 10%, (normally from 3% to 5%) of silicate solids by weight of the percarbonate. However the most preferred coating is a mixture of sodium carbonate and sulphate or sodium chloride.

The particle size range of the crystalline percarbonate is from 350 micrometers to 1500 micrometers with a mean of approximately 500–1000 micrometers.

Hydrophobic Peroxyacid Bleach Precursor

One form of the essential hydrophobic bleach system component of the invention is a hydrophobic peroxyacid bleach precursor which produces upon perhydrolysis hydrophobic peroxyacid whose parent carboxylic acid has a critical micelle concentration less than 0.5 moles/liter and wherein said critical micelle concentration is measured in aqueous solution at 25° C. and pH 7.

Preferably, the peroxyacid backbone chain contains at least 7 carbons which may be linear or partly or totally branched or cyclic and any mixtures thereof.

The peroxyacid bleach precursors are normally incorporated at a level of from 0.1% to 60%, preferably from 3% to 40% and most preferably 3 to 25% by weight of the perfumed detergent composition.

Preferably, hydrophobic peroxyacid bleach precursor compounds are selected from bleach precursor compounds which comprise at least one acyl group forming the peroxyacid moiety bonded to a leaving group through an —O— or —N—linkage.

Suitable peroxyacid bleach precursors for the purpose of the invention are the amide substituted compounds of the following general formulae:

R1N(R5)C(O)R2C(O)L or R1C(O)N(R5)R2C(O)L wherein R1 is an aryl or alkaryl group with from 1 to 14 carbon atoms, R2 is an alkylene, arylene, and alkarylene group containing from 1 to 14 carbon atoms, and R5 is H or an alkyl, aryl, or alkaryl group containing 1 to 10 carbon atoms and L can be essentially any leaving group. R1 preferably contains from 6 to 12 carbon atoms. R2 preferably contains from 4 to 8 carbon atoms. R1 may be straight chain or branched alkyl, substituted aryl or alkylaryl containing branching, substitution, or both and may be sourced from either synthetic sources or natural sources including for example, tallow fat. Analogous structural variations are permissible for R2. R2 can include alkyl, aryl, wherein said R2 may also contain halogen, nitrogen, sulphur and other typical substituent groups or organic compounds. R5 is preferably H or methyl. R1 and R5 should not contain more than 18 carbon atoms total. Amide substituted bleach activator compounds of this type are described in EP-A-0170386.

The leaving group, hereinafter L group, must be sufficiently reactive for the perhydrolysis reaction to occur within the optimum time frame (e.g., a wash cycle). However, if L is too reactive, this activator will be difficult to stabilize for use in a detergent composition.

Preferred L groups are selected from:

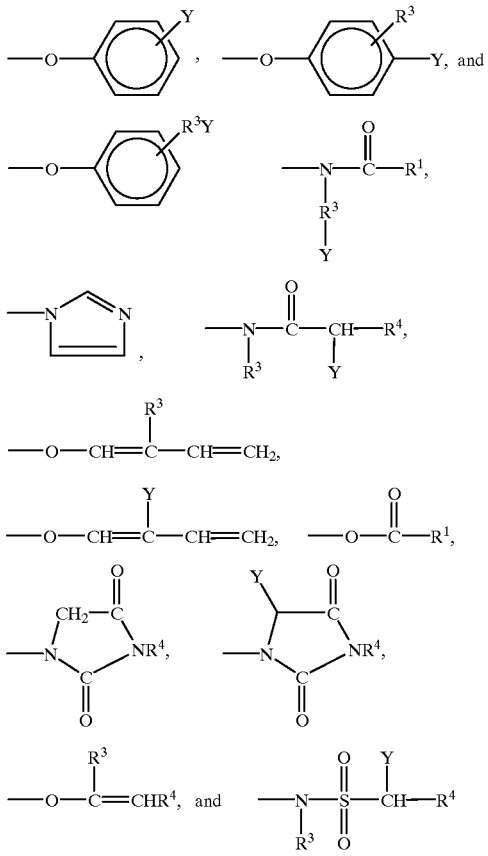

and mixtures thereof, wherein R1is an alkyl, aryl, or alkaryl group containing from 1 to 14 carbon atoms, R3 is an alkyl chain containing from 1 to 8 carbon atoms, R4 is H or R3, and Y is H or a solubilizing group. Any of R1, R3 and R4 may be substituted by essentially any functional group including, for example alkyl, hydroxy, alkoxy, halogen, amine, nitrosyl, amide and ammonium or alkyl ammmonium groups The preferred solubilizing groups are —SO3-M+, —CO 2-M+, —SO4-M+, —N+(R3)4X— and O<—N(R3)3 and most preferably —SO3-M+ and —CO2-M+ wherein R3 is an alkyl chain containing from 1 to 4 carbon atoms, M is a cation which provides solubility to the bleach activator and X is an anion which provides solubility to the bleach activator. Preferably, M is an alkali metal, ammonium or substituted ammonium cation, with sodium and potassium being most preferred, and X is a halide, hydroxide, methylsulfate or acetate anion.

Other suitable L groups for use herein, include a leaving group selected from a caprolactam leaving group, a valerolactam leaving group and mixture thereof.

Preferred examples of bleach precursors of the above formulae include amide substituted peroxyacid precursor compounds selected from (6-octanamido-caproyl) oxybenzenesulfonate, (6-nonanamidocaproyl)oxy benzene sulfonate, (6-decanamido-caproyl)oxybenzenesulfonate, and mixtures thereof as described in EP-A-0170386.

Still another class of bleach precursor is the class of alkyl percarboxylic acid bleach precursors. Preferred alkyl percarboxylic acid precursors include nonanoyl oxy benzene sulphonate (NOBS described in U.S. Pat. No. 4,412,934) and 3,5,5-tri-methyl hexanoyl oxybenzene sulfonate (ISONOBS described in EP120,591) and salts thereof.

Still another class of hydrophobic bleach activators are the N-acylated precursor compounds of the lactam class disclosed generally in GB-A-955735. Preferred materials of this class comprise the caprolactams.

Suitable caprolactam bleach precursors are of the formula:

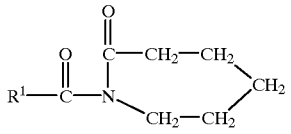

wherein $R^1$ is an alkyl, aryl, alkoxyaryl or alkaryl group containing from 6 to 12 carbon atoms. Preferred hydrophobic N-acyl caprolactam bleach precursor materials are selected from benzoyl caprolactam, octanoyl caprolactam, nonanoyl caprolactam, decanoyl caprolactam, undecenoyl caprolactam, 3,5,5-trimethylhexanoyl caprolactam and mixtures thereof. A most preferred is nonanoyl caprolactam.

Suitable valero lactams have the formula:

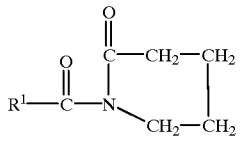

wherein $R^1$ is an alkyl, aryl, alkoxyaryl or alkaryl group containing from 6 to 12 carbon atoms. More preferably, $R^1$ is selected from phenyl, heptyl, octyl, nonyl, 2,4,4-trimethylpentyl, decenyl and mixtures thereof.

Mixtures of any of the peroxyacid bleach precursor, herein before described, may also be used.

Optional Co-precursors

Other bleach precursors may be used in addition to the hydrophobic bleach precursor so as to provide a detergent composition with a broader spectrum of soil removal. These may include cationic bleach precursors, hydrophilic bleach precursors and mixtures thereof.

Suitable cationic bleach precursors are described in U.S. Pat. Nos. 4,904,406; 4,751,015; 4,988,451; 4,397,757; 5,269,962; 5,127,852; 5,093,022; 5,106,528; GB 1,382,594; EP 475,512, 458,396 and 284,292; and in JP 87-318,332. Examples of preferred cationic peroxyacid precursors are described in GB Patent Application No. 9407944.9 and U.S. patent application Ser. Nos. 08/298903, 08/298650, 081298904 and 08/298906.

Suitable cationic peroxyacid precursors include any of the ammonium or alkyl ammonium substituted alkyl or benzoyl oxybenzene sulfonates, N-acylated caprolactams, N-acylated valerolactams and monobenzoyltetraacetyl glucose benzoyl peroxides.

Preferred cationic bleach precursors are derived from the valerolactam and acyl caprolactam compounds, of formula:

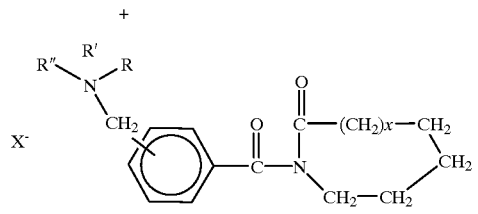

wherein x is 0 or 1, substituents R, R' and R" are each C1–C10 alkyl or C2–C4 hydroxy alkyl groups, or $[(C_yH_{2y})O]_n$-R'" wherein y=2–4, n=1–20 and R'" is a C1–C4 alkyl group or hydrogen and X is an anion.

Suitable hydrophilic peroxyacid bleach precursors include the tetraacetyl ethylene diamine (TAED) bleach precursor.

Highly preferred among these additional activators is the hydrophilic peroxyacid bleach precursor tetraacetyl ethylene diamine (TAED) bleach precursor.

When present, said co-precursors will normally be incorporated at a level of from 0.1% to 60%, preferably from 1% to 40% and most preferably 3 to 25% by weight of the perfumed detergent composition.

Still other suitable bleaching compounds to be used in addition to the hydrophobic bleaching agents are organic or metal based bleach catalysts.

Suitable metal based bleach catalysts include the manganese-based complexes disclosed in U.S. Pat. No. 5,246,621 and U.S. Pat. No. 5,244,594. Preferred examples of these catalysts include $Mn^{IV}_2(u\text{-}O)_3$(1,4,7-trimethyl-1,4,7-triazacyclononane)$_2$-$(PF_6)_2$, $Mn^{III}_2(u\text{-}O)_1(u\text{-}OAc)_2$(1,4,7-trimethyl-1,4,7-triazacyclononane)$_2$-$(ClO_4)_2$, $Mn^{IV}_4(u\text{-}O)_6$(1,4,7-triazacyclononane)$_4$-$(ClO_4)_2$, $Mn^{III}Mn^{IV}_4(u\text{-}O)_1(u\text{-}OAc)_2$-(1,4,7-trimethyl-1,4,7-triazacyclononane)$_2$-$(ClO_4)_3$, and mixtures thereof. Others are described in EP 549,272. Other ligands suitable for use herein include 1,5,9-trimethyl-1,5,9-triazacyclododecane, 2-methyl-1,4,7-triazacyclononane, 2-methyl-1,4,7-triazacyclononane, 1,2,4,7-tetramethyl-1,4,7-triazacyclononane, and mixtures thereof.

For examples of suitable bleach catalysts see U.S. Pat. Nos. 4,246,612 and 5,227,084. See also U.S. Pat. No. 5,194,416 which teaches mononuclear manganese (IV) complexes such as Mn(1,4,7-trimethyl-1,4,7-triazacyclononane)$(OCH_3)_3$-$(PF_6)$. Other types of bleach catalyst are disclosed in U.S. Pat. Nos. 5,114,606 and 5,114,611

Still other bleach catalysts are described, for example, in EP 408,131 (cobalt complex catalysts), EP 384,503, and 306,089 (metallo-porphyrin catalysts), U.S. Pat. Nos. 4,728,455 (manganese/multidentate ligand catalyst), 4,711,748 and EP 224,952, (absorbed manganese on aluminosilicate catalyst), U.S. Pat. No. 4,601,845 (aluminosilicate support with manganese and zinc or magnesium salt), U.S. Pat. No. 4,626,373 (manganese/ligand catalyst), U.S. Pat. No. 4,119,557 (ferric complex catalyst), German Pat. specification 2,054,019 (cobalt chelant catalyst) Canadian 866,191 (transition metal-containing salts), U.S. Pat. No. 4,430,243 (chelants with manganese cations and non-catalytic metal cations), and U.S. Pat. No. 4,728,455 (manganese gluconate catalysts).

Typical levels of catalysts are such as to provide on the order of at least one part per ten million of the active bleach catalyst species in the aqueous washing liquor, and will preferably provide from 0.1 ppm to 700 ppm, more preferably from 1 ppm to 500 ppm, of the catalyst species in the laundry liquor.

Still other suitable bleaching compounds to be used in addition to the hydrophobic bleaching agents are bleaching agents of the hypohalite type that are oxidative bleaches and subsequently lead to the formation of halide ion. Common among these types of bleaches are the alkaline metal and alkaline earth metal hypochlorites, hypobromites and hypoiodites although other bleaches that are organic based sources of halide, such as chloroisocyanurates, are also applicable.

Examples of hypohalite bleaches include sodium hypochlorite, potassium hypochlorite, calcium hypochlorite, magnesium hypochlorite, sodium hypobromite, potassium hypobromite, calcium hypobromite, magnesium hypobromite, sodium hypoiodite and potassium hypoiodite.

Preformed Hydrophobic Peroxyacid Compound

Another form of the essential hydrophobic bleach system component of the invention is a preformed hydrophobic peroxyacid bleaching agent and salt thereof whose parent carboxylic acid has a critical micelle concentration less than 0.5 moles/liter and wherein said critical micelle concentration is measured in aqueous solution at 25° C. and pH 7.

Preferably, the peroxyacid backbone chain contains at least 7 carbons which may be linear, partly or totally branched, or cyclic and any mixtures thereof.

Preferably, hydrophobic peroxyacid bleach compounds are selected from peroxyacid bleach compounds which comprise at least one acyl group forming the peroxyacid moiety bonded to a leaving group through an —O—or —N— linkage.

Preformed hydrophobic peroxyacid compounds will typically be in amount of from 0.1% to 60%, preferably from 3% to 20% by weight.

Suitable examples of this class of agents include (6-octylamino)-6-oxo-caproic acid, (6-nonylamino)-6-oxo-caproic acid, (6-decylamino)-6-oxo-caproic acid, magnesium monoperoxyphthalate hexahydrate, the magnesium salt of metachloro perbenzoic acid, 4-nonylamino-4-oxoperoxybutyric acid and diperoxydodecanedioic acid. Such bleaching agents are disclosed in U.S. Pat. Nos. 4,483,781, 4,634,551, EP 0,133,354, U.S. Pat. No. 4,412, 934 and EP 0,170,386. A preferred hydrophobic preformed peroxyacid bleach compound for the purpose of the invention is monononylamido peroxycarboxylic acid.

Perfume Composition

Another essential component of the invention is a perfume composition. The compositions of the invention comprise said perfume composition, or mixtures thereof, in amounts of up to 5.0%, preferably 0.01% to 2%, most preferably from 0.05% to 1% by weight of the detergent composition.

Suitable perfumes herein include materials which provide an olfactory aesthetic benefit and/or cover any "chemical" odor that the product may have.

Preferably the perfume composition comprises aroma chemicals selected from primary and secondary alcohols, aliphatic aldehydes, hydrocinnamic aldehydes, esters excluding salicylates, unsaturated ketones and mixtures thereof.

Primary alcohols suitable for the purpose of the invention are 3,7-dimethyl-6-octen-1-ol, 3,7-dimethyl-2,6-octadien-1-ol, phenyl ethyl alcohol, 1-pentanol, 3-methyl-5-phenyl and cyclohexyl ethyl alcohol. Preferred primary alcohols are 3,7-dimethyl-6-octen-1-ol, 3,7-dimethyl -2,6-octadien-1-ol and phenyl ethyl alcohol.

Secondary alcohols suitable for use in the perfume composition are cyclohexanol,2-tertiary butyl, 4-methyl-3-decen-5-ol, cyclohexanol,4-tertiary butyl and 4-iso propyl cyclohexanol. Preferred secondary alcohols are cyclohexanol,2-tertiary butyl and 4-methyl-3-decen-5-ol. When used such alcohols compounds will be at a level of from 1% to 50%, preferably at a level of from 20% to 45% and more preferably from 25% to 35% by weight of the perfume composition.

Aliphatic aldehydes suitable for the purpose of the invention are octanal, nonanal, decanal, undecanal, dodecanal, 10-undecenal, 2-methyl undecanal and 2-methyl decanal. Hydrocinnamic aldehydes suitable for the purpose of the invention are 2-methyl-3-(4-tertiary butyl phenyl) propanal and 2-methyl-3-(4-iso propyl phenyl) propanal. When used such aliphatic and hydrocinnamic aldehydes will be at a level of up to 30%, preferably at a level of up to 20% and more preferably up to 10% by weight of the perfume composition.

Esters, excluding salicylates, suitable for the purpose of the invention are benzyl acetate, benzyl propionate, phenyl ethyl acetate, citronellyl acetate, geranyl acetate, 2-methyl-3-phenyl-propan-2-yl acetate, 4-tertiary butyl cyclohexyl acetate, 2-tertiary butyl cyclohexyl acetate, hexahydro-4,7-methano-inden-5-yl acetate, hexahydro-4,7-methano -inden-6-yl acetate, hexahydro-4,7-methano-inden-5-yl propionate, hexahydro-4,7-methano-inden-6-yl propionate and methyl benzoate. Preferred esters, excluding salicylates, are 2-methyl-3-phenyl-propan-2-yl acetate, 2-tertiary butyl cyclohexyl acetate, hexahydro-4,7-methano-inden-5-yl acetate, hexahydro-4,7-methano-inden-6-yl acetate, hexahydro-4,7-methano-inden-5-yl propionate, hexahydro-4,7-methano-inden-6-yl propinate and methyl benzoate. When used such esters excluding salicylates will be at a level of from 5% to 50%, preferably at a level of from 10% to 40% and more preferably from 25% to 35% by weight of the perfume composition.

Unsaturated ketones suitable for the purpose of the invention are 7-acetyl 1,2,3,4,5,6,7,8-octanhydro 1,1,6,7 tetra methyl naphtalene, 3-buten-2-one 3-methyl-4-(2,6,6, trimethyl-2- cyclohexen-1-yl), 3-buten-2-one 4-(2,6,6-trimethyl-1-cyclohexen-1-yl), 3-buten-2-one 4-(2,6,6-trimethyl-2-cyclohexen-1-yl) and ketone cedr-8-enyl methyl. When used such unsaturated ketones will be at a level of from up to 30%, preferably at a level of up to 25% by weight of the perfume composition.

The total sum of the weight of said aroma chemicals, described herein before, present in the perfume composition is at least 30%, preferably at least 50% and more preferably at least 80% by weight of the perfume.

Additional perfume ingredients which may be of use herein are given in "Perfume and Flavor Chemicals (Aroma Chemicals)," Steffen Arctander, published by the author, 1969, along with their odor character, and their physical and chemical properties, such as boiling point and molecular weight.

If necessary, the perfume composition may further be protected from the oxidative environment which arise upon storage. This may be done by encapsulation of the perfume with silica material as described in EP 332259 or adsorption onto porous carrier as disclosed in UK 2,066,839, U.S. Pat. Nos. 4,539,135; 4,713,193, 4,304,675, WO 94/19449 and WO 94/28107.

Metal Ion Sequestrants

The other essential component of the invention is a metal ion sequestrant. By metal ion sequestrants it is meant components which act to sequester (chelate) metal ions. These components may also have calcium and magnesium chelation capacity, but preferentially they bind heavy metal ions such as iron, manganese and copper.

Metal ion sequestrants are preferably present at a level of from 0.6% to 20%, more preferably from 0.8% to 10%, most preferably from 1% to 5% by weight of the compositions.

Metal ion sequestrants, which are acidic in nature, having for example phosphonic acid or carboxylic acid functionalities, may be present either in their acid form or as a complex/salt with a suitable counter cation such as an alkali or alkaline metal ion, ammonium, or substituted ammonium ion, or any mixtures thereof. Preferably any salts/complexes are water soluble. The molar ratio of said counter cation to the metal ion sequestrant is preferably at least 1:1.

Suitable metal ion sequestrants for use herein include the organo aminophosphonates, such as the amino alkylene poly (alkylene phosphonates) and nitrilo trimethylene phosphonates. Preferred organo aminophosphonates are diethylene triamine penta (methylene phosphonate) and hexamethylene diamine tetra (methylene phosphonate).

Other suitable metal ion sequestrants for use herein include polyaminocarboxylic acids such as ethylenediamine-N,N'-disuccinic acid (EDDS), ethylenediamine tetraacetic acid (EDTA), N-hydroxyethylenediamine triacetic acid, nitrilotriacetic acid (NTA), ethylene diamine tetrapropionic acid, ethylenediamine-N,N'-diglutamic acid, 2-hydroxypropylenediamine-N,N'-disuccinic acid, triethylenetetraamine hexacetic acid, diethylenetriamine pentaacetic acid (DETPA), trans 1,2 diaminocyclohexane-N,N,N',N'-tetraacetic acid or ethanoldiglycine. Especially preferred is ethylenediamine-N,N'-disuccinic acid (EDDS), most preferably present in the form of its S,S isomer, which is preferred for its biodegradability profile.

Still other suitable metal ion sequestrants for use herein are iminodiacetic acid derivatives such as 2-hydroxyethyl diacetic acid or glyceryl imino diacetic acid, described in EP-A -0,317,542 and EP-A-0,399,133.

In a particular embodiment, the detergent composition of the invention has further been found to produce an enhanced perfume scent benefit in presence of one or more crystal growth inhibitor compound of the organo diphosphonic acid type. Salts or complexes of these diphosphonic compounds are also considered herein.

Crystal Growth Inhibitor

The organo diphosphonic acid component is an optional ingredient herein preferably present at a level of from 0.1% to 20%, more preferably from 0.15% to 15%, most preferably from 0.2% to 2% by weight of the compositions.

By organo diphosphonic acid it is meant herein an organo diphosphonic acid which does not contain nitrogen as part of its chemical structure. This definition therefore excludes the organo aminophosphonates, which however may be included in compositions of the invention as heavy metal ion sequestrants.

The organo diphosphonic acid component may be present in its acid form or in the form of one of its salts or complexes with a suitable counter cation. Preferably any salts/complexes are water soluble, with the alkali metal and alkaline earth metal salts/complexes being especially preferred.

The organo diphosphonic acid is preferably a $C_1$–$C_4$ diphosphonic acid and more preferably a $C_2$ diphosphonic acid selected from ethylene diphosphonic acid, α-hydroxy-2 phenyl ethyl diphosphonic acid, methylene diphosphonic acid, vinylidene 1,1 diphosphonic acid, 1,2 dihydroxyethane 1,1 diphosphonic acid and hydroxy-ethane 1,1 diphosphonic acid and any salts thereof and mixtures thereof.

A most preferred organo diphosphonic acid is hydroxyethane 1,1 diphosphonic acid (HEDP).

Surfactants

The detergent composition of the invention will also comprise optionally but preferably one or more surfactants selected from anionic, cationic, nonionic, ampholytic, amphoteric and zwitterionic surfactants and mixtures thereof. A typical listing of anionic, nonionic, ampholytic, and zwitterionic classes, and species of these surfactants, is given in U.S. Pat. No. 3,929,678 issued to Laughlin and Heuring on Dec. 30, 1975. Further examples are given in "Surface Active Agents and Detergents" (Vol. I and II by Schwartz, Perry and Berch). A list of suitable cationic surfactants is given in U.S. Pat. No. 4,259,217 issued to Murphy on Mar. 31, 1981.

Nonlimiting examples of surfactants useful herein include the conventional $C_{11}$–$C_{18}$ alkyl benzene sulfonates ("LAS") and primary, branched-chain and random $C_{10}$–$C_{20}$ alkyl sulfates ("AS"), the $C_{10}$–$C_{18}$ secondary (2,3) alkyl sulfates of the formula $CH_3(CH_2)_x(CHOSO_3^-M^+)CH_3$ and $CH_3(CH_2)_y(CHOSO_3^-M^+)CH_2CH_3$ where x and (y+1) are integers of at least 7, preferably at least 9, and M is a water-solubilizing cation, especially sodium, unsaturated sulfates such as oleyl sulfate, the $C_{10}$–$C_{18}$ alkyl alkoxy sulfates ("$AE_xS$"; especially EO 1–7 ethoxy sulfates), $C_{10}$–$C_{18}$ alkyl alkoxy carboxylates (especially the EO 1–5 ethoxycarboxylates), the $C_{10}$–$C_{18}$ glycerol ethers, the $C_{10}$–$C_{18}$ alkyl polyglycosides and their corresponding sulfated polyglycosides, and $C_{12}$–$C_{18}$ alpha-sulfonated fatty acid esters. If desired, the conventional nonionic and amphoteric surfactants such as the $C_{12}$–$C_{18}$ alkyl ethoxylates ("AE"), including the so-called narrow peaked alkyl ethoxylates and $C_6$–$C_{12}$ alkyl phenol alkoxylates (especially ethoxylates and mixed ethoxy/propoxy), $C_{12}$–$C_{18}$ betaines and sulfobetaines ("sultaines"), $C_{10}$–$C_{18}$ amine oxides, and the like, can also be included in the overall compositions. The $C_{10}$–$C_{18}$ N-alkyl polyhydroxy fatty acid amides can also be used. Typical examples include the $C_{12}$–$C_{18}$ N-methylglucamides. See WO 9,206,154. Other sugar-derived surfactants include the N-alkoxy polyhydroxy fatty acid amides, such as $C_{10}$–$C_{18}$ N (3-methoxypropyl) glucamide. The N-propyl through N-hexyl $C_{12}$–$C_{18}$ glucamides can be used for low sudsing. $C_{10}$–$C_{20}$ conventional soaps may also be used. If high sudsing is desired, the branched-chain $C_{10}$–$C_{16}$ soaps may be used.

Other suitable surfactants suitable for the purpose of the invention are the anionic alkali metal sarcosinates of formula:

$$R—CON(R^1)CH_2COOM$$

wherein R is a $C_9$–$C_{17}$ linear or branched alkyl or alkenyl group, $R^1$ is a $C_1$–$C_4$ alkyl group and M is an alkali metal ion. Preferred examples are the lauroyl, cocoyl ($C_{12}$–$C_{14}$), myristyl and oleyl methyl sarcosinates in the form of their sodium salts.

Mixtures of anionic and nonionic surfactants are especially useful. Other conventional useful surfactants are listed in standard texts.

The total amount of surfactants will be generally up to 70%, typically 1 to 55% by weight of the detergent composition. Preferably, high levels of surfactants present in a total amount of at least 11% by weight, more preferably 20% by weight of the detergent composition have been found to be beneficial to the cleaning performance of the detergent composition. Most preferably, a better cleaning performance is observed where at least one of the surfactant component is an anionic surfactant.

The detergent compositions of the invention may also contain additional detergent components. The precise nature of these additional components and levels of incorporation thereof will depend on the physical form of the composition, and the nature of the cleaning operation for which it is to be used.

The compositions of the invention may, for example, be formulated as hand and machine laundry detergent compositions, including laundry additive compositions and compositions suitable for use in the pretreatment of stained fabrics and machine dishwashing compositions.

Additional Optional Detergent Components

Builders

Detergent builders can optionally be included in the compositions herein to assist in controlling mineral hardness. Inorganic as well as organic builders can be used. Builders are typically used in fabric laundering compositions to assist in the removal of particulate soils.

The level of builder can vary widely depending upon the end use of the composition and its desired physical form. When present, the compositions will typically comprise at least 1% builder. Granular formulations typically comprise from 5% to 80%, more preferably less than 25% by weight, of the detergent builder. Lower or higher levels of builder, however, are not meant to be excluded.

Builders, especially non phosphorus containing builders, present at low levels such as less than 25% by weight of the detergent composition have been found to provide a fabric encrustation problem, which thus reduces the amount of perfume deposition on the fabric. The detergent composition of the invention has surprisingly been found to be beneficial to the scent of laundered fabric even in the presence of such low level of builders.

Inorganic or phosphate-containing detergent builders include, but are not limited to, the alkali metal, ammonium and alkanolammonium salts of polyphosphates (exemplified by the tripolyphosphates, pyrophosphates, and glassy polymeric meta-phosphates).

Non-phosphate builders may also be used. These can include, but are not restricted to phytic acid, silicates, alkali metal carbonates (including bicarbonates and sesquicarbonates), sulphates, aluminosilicates, monomeric polycarboxylates. Examples of silicate builders are the crystalline layered silicates, such as the layered sodium silicates described in U.S. Pat. No. 4,664,839. NaSKS-6 is the trademark for a crystalline layered silicate marketed by Hoechst (commonly abbreviated herein as "SKS-6"). Unlike zeolite builders, the Na SKS-6 silicate builder does not contain aluminium. NaSKS-6 has the delta-$Na_2Si_2O_5$ morphology form of layered silicate. It can be prepared by methods such as those described in DE-A-3,417,649 and DE-A-3,742,043. SKS-6 is a highly preferred layered silicate for use herein, but other such layered silicates, such as those having the general formula $NaMSi_xO_{2x+1}.yH_2O$ wherein M is sodium or hydrogen, x is a number from 1.9 to 4, preferably 2, and y is a number from 0 to 20, preferably 0 can be used herein. Various other layered silicates from Hoechst include NaSKS-5, NaSKS-7 and NaSKS-11, as the alpha, beta and gamma forms. As noted above, the delta-$Na_2Si_2O_5$ (NaSKS-6 form) is most preferred for use herein. Other silicates may also be useful such as for example magnesium silicate, which can serve as a crispening agent in granular formulations, as a stabilising agent for oxygen bleaches, and as a component of suds control systems.

Aluminosilicate builders are of great importance in most currently marketed heavy duty granular detergent compositions, and can also be a significant builder ingredient in liquid detergent formulations. Aluminosilicate builders include those having the empirical formula:

$$Na_z[(AlO_2)_z(SiO_2)_y].xH_2O$$

wherein z and y are integers of at least 6, the molar ratio of z to y is in the range from 1.0 to 0.5, and x is an integer from 15 to 264.

Useful aluminosilicate ion exchange materials are commercially available. These aluminosilicates can be crystalline or amorphous in structure and can be naturally-occurring aluminosilicates or synthetically derived. A method for producing aluminosilicate ion exchange materials is disclosed in U.S. Pat. No. 3,985,669. Preferred synthetic crystalline aluminosilicate ion exchange materials useful herein are available under the designations Zeolite A, Zeolite P (B), Zeolite MAP and Zeolite X. In an especially preferred embodiment, the crystalline aluminosilicate ion exchange material has the formula:

$$Na_{12}[(AlO_2)_{12}(SiO_2)_{12}].xH_2O$$

wherein x is from 20 to 30, especially 27. This material is known as Zeolite A. Dehydrated zeolites (x=0–10) may also be used herein. Preferably, the aluminosilicate has a particle size of 0.1–10 microns in diameter.

Suitable organic detergent builders include, but are not restricted to, a wide variety of polycarboxylate compounds. As used herein, "polycarboxylate" refers to compounds having a plurality of carboxylate groups, preferably at least 3 carboxylates. Polycarboxylate builder can generally be added to the composition in acid form, but can also be added in the form of a neutralised salt. When utilized in salt form, alkali metals, such as sodium, potassium, and lithium, or alkanolammonium salts are preferred.

Included among the polycarboxylate builders are a variety of categories of useful materials. One important category of polycarboxylate builders encompasses the ether polycarboxylates, including oxydisuccinate, as disclosed in U.S. Pat. No. 3,128,287 and U.S. Pat. No. 3,635,830. See also "TMS/TDS" builders of U.S. Pat. No. 4,663,071. Suitable ether polycarboxylates also include cyclic compounds, particularly alicyclic compounds, such as those described in U.S. Pat. Nos. 3,923,679; 3,835,163; 4,158,635; 4,120,874 and 4,102,903.

Other useful detergency builders include the ether hydroxypolycarboxylates, copolymers of maleic anhydride with ethylene or vinyl methyl ether, or acrylic acid, 1,3,5-trihydroxy benzene-2,4,6-trisulphonic acid, and carboxymethyloxysuccinic acid, the various alkali metal, ammonium and substituted ammonium salts of polyacetic acids such as ethylenediamine tetraacetic acid and nitrilotriacetic acid, as well as polycarboxylates such as mellitic acid, succinic acid, oxydisuccinic acid, polymaleic acid, benzene 1,3,5-tricarboxylic acid, carboxymethyloxysuccinic acid, and soluble salts thereof.

Citrate builders, e.g., citric acid and soluble salts thereof (particularly sodium salt), are polycarboxylate builders of particular importance for heavy duty liquid detergent formulations due to their availability from renewable resources and their biodegradability. Citrates can also be used in granular compositions, especially in combination with zeolite and/or layered silicate builders. Oxydisuccinates are also especially useful in such compositions and combinations.

Also suitable in the compositions of the invention are the 3,3-dicarboxy-4-oxa-1,6-hexanedioates and the related compounds disclosed in U.S. Pat. No. 4,566,984. Useful succinic acid builders include the $C_5$–$C_{20}$ alkyl and alkenyl succinic acids and salts thereof. A particularly preferred compound of this type is dodecenylsuccinic acid. Specific examples of succinate builders include: laurylsuccinate, myristylsuccinate, palmitylsuccinate, 2-dodecenyilsuccinate (preferred), 2-pentadecenylsuccinate, and the like. Laurylsuccinates are the preferred builders of this group, and are described in EP 0,200,263. Other suitable polycarboxylates are disclosed in U.S. Pat. Nos. 4,144,226 and in 3,308,067. See also 3,723,322.

Fatty acids, e.g., $C_{12}$–$C_{18}$ monocarboxylic acids, can also be incorporated into the compositions alone, or in combination with the aforesaid builders, especially citrate and/or the succinate builders, to provide additional builder activity. Such use of fatty acids will generally result in a diminution of sudsing, which should be taken into account by the formulator.

Detergent Adjunct Materials

The compositions herein can optionally include one or more other detergent adjunct materials or other materials for assisting or enhancing cleaning performance, treatment of the substrate to be cleaned, or to modify the aesthetics of the detergent composition (e.g. colorants, dyes, etc.). The following are illustrative examples of such adjunct materials.

Enzymes

The enzymes to be incorporated include proteases, amylases, lipases, cellulases, and peroxidases, as well as mixtures thereof. Other types of enzymes may also be included. They may be of any suitable origin, such as vegetable, animal, bacterial, fungal and yeast origin. However, their choice is governed by several factors such as pH-activity and/or stability optima, thermostability and stability versus active detergents and builders. In this respect bacterial or fungal enzymes are preferred, such as bacterial amylases and proteases, and fungal cellulases.

Enzymes are normally incorporated at levels sufficient to provide up to 5 mg by weight, more typically 0.01 mg to 3 mg, of active enzyme per gram of the composition. Stated otherwise, the compositions herein will typically comprise from 0.001% to 5%, preferably 0.01% –1% by weight of a commercial enzyme preparation.

Suitable examples of proteases are the subtilisins which are obtained from particular strains of B. subtilis and B. licheniforms. Another suitable protease is obtained from a strain of Bacillus, having maximum activity throughout the pH range of 8–12, developed and sold by Novo Industries A/S under the registered trade name ESPERASE. The preparation of this enzyme and analogous enzymes is described in GB 1,243,784 of Novo. Proteolytic enzymes suitable for removing protein-based stains that are commercially available include those sold under the tradenames ALCALASE and SAVINASE by Novo Industries A/S (Denmark) and MAXATASE by International Bio-Synthetics, Inc. (The Netherlands). Other proteases include Protease A (see EP 130,756) and Protease B (see EP257189).

Amylases include, for example, α-amylases described in GB 1,296,839 (Novo), RAPIDASE, International Bio-Synthetics, Inc. and TERMAMYL, Novo Industries. Fungamyl (Novo) is especially useful.

The cellulases usable in the present invention include both bacterial or fungal cellulase. Preferably, they will have a pH optimum of between 5 and 9.5. Suitable cellulases are disclosed in U.S. Pat. No. 4,435,307, which discloses fungal cellulase produced from Humicola insolens and Humicola strain DSM1800 or a cellulase 212-producing fungus belonging to the genus Aeromonas, and cellulase extracted from the hepatopancreas of a marine mollusk (Dolabella Auricula Solander). Suitable cellulases are also disclosed in GB-A-2.075.028; GB-A-2.095.275 and DE-OS-2.247.832. ENDO A, CAREZYME both from Novo Industries A/S are especially useful.

Suitable lipase enzymes for detergent usage include those produced by microorganisms of the Pseudomonas group, such as *Pseudomonas stutzeri* ATCC 19.154, as disclosed in GB 1,372,034. See also lipases in Japanese Patent Application 53,20487, laid open to public inspection on Feb. 24, 1978. This lipase is available from Amano Pharmaceutical Co. Ltd., Nagoya, Japan, under the trade name Lipase P "Amano," hereinafter referred to as "Amano-P." Other commercial lipases include Amano-CES, lipases ex Chromobacter viscosum, e.g. Chromobacter viscosum var. lipolyticum NRRLB 3673, commercially available from Toyo Jozo Co., Tagata, Japan; and further Chromobacter viscosum lipases from U.S. Biochemical Corp., U.S.A. and Disoynth Co., The Netherlands, and lipases ex *Pseudomonas gladioli*. The LIPOLASE enzyme derived from Humicola lanuginosa and commercially available from Novo (see also EP 341, 947) is a preferred lipase for use herein.

Peroxidase enzymes are used in combination with oxygen sources, e.g., percarbonate, perborate, persulfate, hydrogen peroxide, etc. They are used for "solution bleaching," i.e. to prevent transfer of dyes or pigments removed from substrates during wash operations to other substrates in the wash solution. Peroxidase enzymes are known in the art, and include, for example, horseradish peroxidase, ligninase, and haloperoxidase such as chloro- and bromo-peroxidase. Peroxidase-containing detergent compositions are disclosed, for example, in WO 89/099813.

A wide range of enzyme materials and means for their incorporation into synthetic detergent compositions are also disclosed in U.S. Pat. No. 3,553,139. Enzymes are further disclosed in U.S. Pat. No. 4,101,457 and in U.S. Pat. No. 4,507,219. Enzyme materials useful for liquid, detergent formulations, and their incorporation into such formulations, are disclosed in U.S. Pat. No. 4,261,868. Enzymes for use in detergents can be stabilized by various techniques. Enzyme stabilisation techniques are disclosed and exemplified in U.S. Pat. No. 3,600,319 and EP 0,199,405. Enzyme stabilisation systems are also described, for example, in U.S. Pat. No. 3,519,570.

Polymeric Dispersing Agents

Polymeric dispersing agents can be utilized at levels from 0.5% to 8%, by weight, in the compositions herein, especially in the presence of zeolite and/or layered silicate builders. Suitable polymeric dispersing agents include polymeric polycarboxylates and polyethylene glycols, although others known in the art can also be used.

Polymeric polycarboxylate materials can be prepared by polymerizing or copolymerizing suitable unsaturated monomers, preferably in their acid form. Unsaturated monomeric acids that can be polymerized to form suitable polymeric polycarboxylates are selected from acrylic acid, maleic acid (or maleic anhydride), fumaric acid, itaconic acid, aconitic acid, mesaconic acid, citraconic acid and methylenemalonic acid. The presence in the polymeric polycarboxylates herein of monomeric segments, containing no carboxylate radicals such as vinylmethyl ether, styrene, ethylene, etc. is suitable provided that such segments do not constitute more than 40% by weight.

Polymeric polycarboxylate materials can also optionally include further monomeric units such as nonionic spacing units. For example, suitable nonionic spacing units may include vinyl alcohol or vinyl acetate.

Particularly preferred polymeric polycarboxylates are co-polymers derived from monomers of acrylic acid and maleic acid. The average molecular weight of such polymers in the acid form preferably ranges from 2,000 to 10,000, more preferably from 4,000 to 7,000 and most preferably from 4,000 to 5,000. Water-soluble salts of such acrylic/maleic acid polymers can include, for example, the alkali metal, ammonium and substituted ammonium salts. Soluble polymers of this type are known materials. Use of polyacrylates of this type in detergent compositions has been disclosed, for example, in Diehl, U.S. Pat. No. 3,308,067, issued Mar. 7, 1967. The ratio of acrylate to maleate segments in such copolymers will generally range from 30:1 to 1:1, more preferably from 10:1 to 2:1. Soluble acrylate/maleate copolymers of this type are known materials which are described in EP 66915 as well as in EP 193,360, which also describes such polymers comprising hydroxypropylacrylate. Of the se acrylic/maleic-based copolymers, the water-soluble salts of copolymers of acrylic acid and maleic acid are preferred.

Another class of polymeric polycarboxylic acid compounds suitable for use herein are the homo-polymeric polycarboxylic acid compounds derived from acrylic acid. The average molecular weight of such homo-polymers in the acid form preferably ranges from 2,000 to 100,000, more preferably from 3,000 to 75,000, most preferably from 4,000 to 65,000.

A further example of polymeric polycarboxylic compounds which may be used herein include the maleic/acrylic/vinyl alcohol terpolymers. Such materials are also disclosed in EP 193,360, including, for example, the 45/45/10 terpolymer of acrylic/maleic/vinyl alcohol.

Another example of polymeric polycarboxylic compounds which may be used herein include the biodegradable polyaspartic acid and polyglutamic acid compounds.

Clay Soil Removal/Anti-redeposition Agents

Granular detergent compositions which contain these compounds typically contain from 0.01% to 10.0% by weight of the water-soluble ethoxylates amines; liquid detergent compositions typically contain 0.01% to 5%.

The most preferred soil release and anti-redeposition agent is ethoxylated tetraethylenepentamine. Exemplary ethoxylated amines are further described in U.S. Pat. No. 4,597,898. Another group of preferred clay soil removal-antiredeposition agents are the cationic compounds disclosed in EP 111,965. Other clay soil removal/antiredeposition agents which can be used include the ethoxylated amine polymers disclosed in EP 111,984; the zwitterionic polymers disclosed in EP 112,592; and the amine oxides disclosed in U.S. Pat. No. 4,548,744 and the carboxy methyl cellulose (CMC) materials. These materials are well known in the art.

Polymeric Soil Release Agent

Polymeric soil release agents are characterised by having both hydrophilic segments, to hydrophilize the surface of hydrophobic fibers, such as polyester and nylon, and hydrophobic segments, to deposit upon hydrophobic fibers and remain adhered thereto through completion of washing and rinsing cycles and, thus, serve as an anchor for the hydrophilic segments. This can enable stains occurring subsequent to treatment with the soil release agent to be more easily cleaned in later washing procedures.

The polymeric soil release agents useful herein especially include those soil release agents having: (a) one or more nonionic hydrophile components consisting essentially of (i) polyoxyethylene segments with a degree of polymerization of at least 2, or (ii) oxypropylene or polyoxypropylene segments with a degree of polymerization of from 2 to 10, wherein said hydrophile segment does not encompass any oxypropylene unit unless it is bonded to adjacent moieties at each end by ether linkages, or (iii) a mixture of oxyalkylene units comprising oxyethylene and from 1 to 30 oxypropylene units wherein said mixture contains a sufficient amount of oxyethylene units such that the hydrophile component has hydrophilicity great enough to increase the hydrophilicity of conventional polyester synthetic fiber surfaces upon deposit of the soil release agent on such surface, said hydrophile segments preferably comprising at least 25% oxyethylene units and more preferably, especially for such components having 20 to 30 oxypropylene units, at least 50% oxyethylene units; or (b) one or more hydrophobe components comprising (i) $C_3$ oxyalkylene terephthalate segments, wherein, if said hydrophobe components also comprise oxyethylene terephthalate, the ratio of oxyethylene terephthalate:$C_3$ oxyalkylene terephthalate units is 2:1 or lower, (ii) $C_4$–$C_6$ alkylene or oxy $C_4$–$C_6$ alkylene segments, or mixtures therein, (iii) poly (vinyl ester) segments, preferably polyvinyl acetate), having a degree of polymerization of at least 2, or (iv) $C_1$–$C_4$ alkyl ether or $C_4$ hydroxyalkyl ether substituents, or mixtures therein, wherein said substituents are present in the form of $C_1$–$C_4$ alkyl ether or $C_4$ hydroxyalkyl ether cellulose derivatives, or mixtures therein, and such cellulose derivatives are amphiphilic, whereby they have a sufficient level of $C_1$–$C_4$ alkyl ether and/or $C_4$ hydroxyalkyl ether units to deposit upon conventional polyester synthetic fiber surfaces and retain a sufficient level of hydroxyls, once adhered to such conventional synthetic fiber surface, to increase fiber surface hydrophilicity, or a combination of (a) and (b).

Typically, the polyoxyethylene segments of (a)(i) will have a degree of polymerization of from 200, although higher levels can be used, preferably from 3 to 150, more preferably from 6 to 100. Suitable oxy $C_4$–$C_6$ alkylene hydrophobe segments include, but are not limited to, end-caps of polymeric soil release agents such as $MO_3S(CH_2)_nOCH_2CH_2O$-, where M is sodium and n is an integer from 4–6, as disclosed in U.S. Pat. No. 4,721,580.

Polymeric soil release agents useful in the present invention also include cellulosic derivatives such as hydroxyether cellulosic polymers, copolymeric blocks of ethylene terephthalate or propylene terephthalate with polyethylene oxide or polypropylene oxide terephthalate, and the like. Such agents are commercially available and include hydroxyethers of cellulose such as METHOCEL (Dow) and carboxy alkyl of cellulose such as Metolose (Shin Etsu). Cellulosic soil release agents for use herein also include those selected from $C_1$–$C_4$ alkyl and $C_4$ hydroxyalkyl cellulose; see U.S. Pat. No. 4,000,093.

Soil release agents characterised by poly(vinyl ester) hydrophobe segments include graft copolymers of poly (vinyl ester), e.g., $C_1$–$C_6$ vinyl esters, preferably poly(vinyl acetate) grafted onto polyalkylene oxide backbones, such as polyethylene oxide backbones (see EP 0 219 048). Commercially available soil release agents of this kind include the SOKALAN type of material, e.g., SCYKALAN HP-22, available from BASF (West Germany).

One type of preferred soil release agent is a copolymer having random blocks of ethylene terephthalate and polyethylene oxide (PEO) terephthalate. The molecular weight of this polymeric soil release agent is in the range of from 25,000 to 55,000. See U.S. Pat. Nos. 3,959,230 and 3,893,929.

Another preferred polymeric soil release agent is a polyester with repeat units of ethylene terephthalate units which contains 10–15% by weight of ethylene terephthalate units together with 90–80% by weight of polyoxyethylene terephthalate units, derived from a polyoxyethylene glycol of average molecular weight 300–5,000. Examples of this polymer include the commercially available material ZEL- CON 5126 (from Dupont) and MILEASE T (from ICI). See also U.S. Pat. No. 4,702,857.

Another preferred polymeric soil release agent is a sulfonated product of a substantially linear ester oligomer comprised of an oligomeric ester backbone of terephthaloyl and oxyalkyleneoxy repeat units and terminal moieties covalently attached to the backbone. These soil release agents are described in U.S. Pat. No. 4,968,451. Other suitable polymeric soil release agents include the terephthalate polyesters of U.S. Pat. No. 4,711,730, the anionic end-capped oligomeric esters of U.S. Pat. No. 4,721,580 and the block polyester oligomeric compounds of U.S. Pat. No. 4,702,857.

Still another preferred soil release agent is an oligomer with repeat units of terephthaloyl units, sulfoisoterephthaloyl units, oxyethyleneoxy and oxy-1,2-propylene units. The repeat units form the backbone of the oligomer and are preferably terminated with modified isethionate end-caps. A particularly preferred soil release agent of this type comprises one sulfoisophthaloyl unit, 5 terephthaloyl units, oxyethyleneoxy and oxy-1,2-propyleneoxy units in a ratio of from 1.7 to 1.8, and two end-cap units of sodium 2-(2-hydroxyethoxy)-ethanesulfonate. Said soil release agent also comprises from 0.5% to 20%, by weight of the oligomer, of a crystalline-reducing stabilizer, preferably selected from xylene sulfonate, cumene sulfonate, toluene sulfonate and mixtures thereof.

Preferred polymeric soil release agents also include the soil release agents of U.S. Pat. No. 4,877,896, which discloses anionic, especially sulfoaroyl, end-capped terephthalate esters.

If utilized, soil release agents will generally comprise from 0.010% to 10.0%, by weight, of the compositions herein, typically from 0.1% to 5%, preferably from 0.2% to 3.0%.

Dye Transfer Inhibiting Agents

Generally, such dye transfer inhibiting agents include polyvinyl pyrrolidone polymers, polyamine N-oxide polymers, copolymers of N-vinylpyrrolidone and N-vinylimidazole, manganese phthalocyanine, peroxidases, and mixtures thereof. If used, these agents typically comprise from 0.01% to 10% by weight of the composition, preferably from 0.01% to 5%, and more preferably from 0.05% to 2%.

More specifically, the polyamine N-oxide polymers preferred for use herein contain units having the following structural formula: R—$A_x$—P; wherein P is a polymerizable unit to which an N—O group can be attached or the N—O group can form part of the polymerizable unit or the N—O group can be attached to both units; A is one of the following structures: —NC(O)—, —C(O)O—, —S—, —O—, —N═; x is 0 or 1; and R is aliphatic, ethoxylated aliphatics, aromatics, heterocyclic or alicyclic groups or any combination thereof to which the nitrogen of the N—O group can be attached or the N—O group is part of these groups. Preferred polyamine N-oxides are those wherein R is a heterocyclic group such as pyridine, pyrrole, imidazole, pyrrolidine, piperidine and derivatives thereof.

The N—O group can be represented by the following general structures:

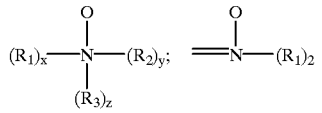

wherein $R_1$, $R_2$, $R_3$ are aliphatic, aromatic, heterocyclic or alicyclic groups or combinations thereof; x, y and z are 0 or 1; and the nitrogen of the N—O group can be attached or form part of any of the aforementioned groups. The amine oxide unit of the polyamine N-oxides has a pKa<10, preferably pKa<7, more preferred pKa<6.

Any polymer backbone can be used as long as the amine oxide polymer formed is water-soluble and has dye transfer inhibiting properties. Examples of suitable polymeric backbones are polyvinyls, polyalkylenes, polyesters, polyethers, polyamide, polyimides, polyacrylates and mixtures thereof. These polymers include random or block copolymers where one monomer type is an amine N-oxide and the other monomer type is an N-oxide. The amine N-oxide polymers typically have a ratio of amine to the amine N-oxide of 10:1 to 1:1,000,000. However, the number of amine oxide groups present in the polyamine oxide polymer can be varied by appropriate copolymerization or by an appropriate degree of N-oxidation. The polyamine oxides can be obtained in almost any degree of polymerization. Typically, the average molecular weight is within the range of 500 to 1,000,000; more preferred 1,000 to 500,000; most preferred 5,000 to 100,000. This preferred class of materials can be referred to as "PVNO".

The most preferred polyamine N-oxide useful in the compositions herein is poly(4-vinylpyridine-N-oxide) which as an average molecular weight of 50,000 and an amine to amine N-oxide ratio of 1:4.

Copolymers of N-vinylpyrrolidone and N-vinylimidazole polymers (referred to as a class as "PVPVI") are also preferred for use herein. Preferably the PVPVI has an average molecular weight range from 5,000 to 1,000,000, more preferably from 5,000 to 200,000, and most preferably from 10,000 to 20,000. (The average molecular weight range is determined by light scattering as described in Barth, et al., *Chemical Analysis*, Vol 113. "Modern Methods of Polymer Characterization".) The PVPVI copolymers typically have a molar ratio of N-vinylimidazole to N-vinylpyrrolidone from 1:1 to 0.2:1, more preferably from 0.8:1 to 0.3:1, most preferably from 0.6:1 to 0.4:1. These copolymers can be either linear or branched.

The present invention compositions also may employ a polyvinyl pyrrolidone ("PVP") having an average molecular weight of from 5,000 to 400,000, preferably from 5,000 to 200,000, and more preferably from 5,000 to 50,000. PVP's are known to persons skilled in the detergent field; see, for example, EP-A-262,897 and EP-A-256,696. Compositions containing PVP can also contain polyethylene glycol ("PEG") having an average molecular weight from 500 to 100,000, preferably from 1,000 to 10,000. Preferably, the ratio of PEG to PVP on a ppm basis delivered in wash solutions is from 2:1 to 50:1, and more preferably from 3:1 to 10:1.

The detergent compositions herein may also optionally contain from 0.005% to 5% by weight of certain types of hydrophilic optical brighteners which also provide a dye transfer inhibition action. If used, the compositions herein will preferably comprise from 0.01% to 1.2% by weight of such optical brighteners.

The hydrophilic optical brighteners useful in the present invention are those having the structural formula:

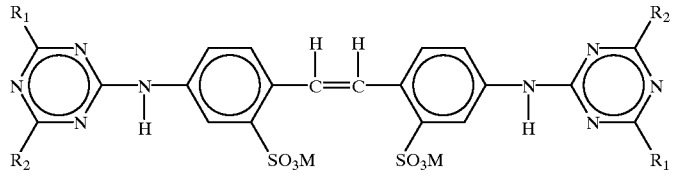

wherein $R_1$ is selected from anilino, N-2-bis-hydroxyethyl and NH-2-hydroxyethyl; $R_2$ is selected from N-2-bis-hydroxyethyl, N-2-hydroxyethyl-N-methylamino, morphilino, chloro and amino; and M is a salt-forming cation such as sodium or potassium.

When in the above formula, $R_1$ is anilino, $R_2$ is N-2-bis-hydroxyethyl and M is a cation such as sodium, the brightener is 4,4',-bis[(4-anilino-6-(N-2-bis-hydroxyethyl)-s-triazine-2-yl)amino]-2,2'-stilbenedisulfonic acid and disodium salt. This particular brightener species is commercially marketed under the tradename Tinopal-UNPA-GX by Ciba-Geigy Corporation.

When in the above formula, $R_1$ is anilino, $R_2$ is N-2-hydroxyethyl-N-2methylamino and M is a cation such as sodium, the brightener is 4,4'-bis[(4-anilino-6-(N-2-hydroxyethyl-N-methylamino)-s-triazine-2-yl)amino]2,2'-stilbenedisulfonic acid disodium salt. This particular brightener species is commercially marketed under the tradename Tinopal 5BM-GX by Ciba-Geigy Corporation.

When in the above formula, $R_1$ is anilino, $R_2$ is morphilino and M is a cation such as sodium, the brightener is 4,4'-bis[(4-anilino-6-morphilino-s-triazine-2-yl)amino]2,2'-stilbenedisulfonic acid, sodium salt. This particular brightener species is commercially marketed under the tradename Tinopal AMS-GX by Ciba Geigy Corporation.

Other conventional optical brightener types of compounds can optionally be used in the present compositions to provide conventional fabric "brightness" benefits, rather than a true dye transfer inhibiting effect. Such usage is conventional and well-known to detergent formulations.

Conventional optical brighteners or other brightening or whitening agents known in the art can be incorporated at levels typically from 0.005% to 5%, preferably from 0.01% to 1.2% and most preferably from 0.05% to 1.2%, by weight, into the detergent compositions herein. Commercial optical brighteners which may be useful can be classified into subgroups, which include, but are not necessarily limited to, derivatives of stilbene, pyrazoline, coumarin, carboxylic acid, methinecyanines, dibenzothiophene-5,5-dioxide, azoles, 5- and 6-membered-ring heterocycles, and other miscellaneous agents. Examples of such brighteners are disclosed in "The Production and Application of Fluorescent Brightening Agents", M. Zahradnik, Published by John Wiley & Sons, New York (1982). Further optical brightener which may also be used include naphthalimide, benzoxazole, benzofuran, benzimidazole and any mixtures thereof.

Specific examples of optical brighteners which are useful in the present compositions are those identified in U.S. Pat. No. 4,790,856. These brighteners include the PHORWHITE series of brighteners from Verona. Other brighteners disclosed in this reference include: Tinopal UNPA, Tinopal CBS and Tinopal 5BM; available from Ciba-Geigy; Artic White CC and Artic White CWD; the 2-(4-styryl-phenyl)-2H-naptho[1,2-d]triazoles; 4,4'-bis(1,2,3-triazol-2-yl)-stilbenes; 4,4'-bis(styryl)bisphenyls; and the aminocoumarins. Specific examples of these brighteners include 4-methyl-7-diethyl-amino coumarin; 1,2-bis(-benzimidazol-2-yl)ethylene; 1,3-diphenyl-pyrazolines; 2,5-bis (benzoxazol-2-yl)thiophene; 2-styryl-naptho-[1,2-d] oxazole; and 2-(stilbene-4-yl)-2H-naphtho[1,2-d]triazole. See also U.S. Pat. No. 3,646,015.

Suds Suppressors

A wide variety of materials may be used as suds suppressors, and suds suppressors are well known to those skilled in the art. See, for example, Kirk Othmer Encyclopedia of Chemical Technology, Third Edition, Volume 7, pages 430–447 (John Wiley & Sons, Inc., 1979). One category of suds suppressor of particular interest encompasses monocarboxylic fatty acid and soluble salts therein. See U.S. Pat. No. 2,954,347. The monocarboxylic fatty acids and salts thereof used as suds suppressor typically have hydrocarbyl chains of 10 to 24 carbon atoms, preferably 12 to 18 carbon atoms. Suitable salts include the alkali metal salts such as sodium, potassium, and lithium salts, and ammonium and alkanolammonium salts.

The detergent compositions herein may also contain non-surfactant suds suppressors. These include, for example: high molecular weight hydrocarbons such as paraffin, fatty acid esters (e.g., fatty acid triglycerides), fatty acid esters of monovalent alcohols, aliphatic $C_{18}$–$C_{40}$ ketones (e.g., stearone), etc. Other suds inhibitors include N-alkylated amino triazines such as tri- to hexa-alkylmelamines or di- to tetra-alkyldiamine chlortriazines formed as products of cyanuric chloride with two or three moles of a primary or secondary amine containing 1 to 24 carbon atoms, propylene oxide, and monostearyl phosphates such as monostearyl alcohol phosphate ester and monostearyl di-alkali metal (e.g., K, Na, and Li) phosphates and phosphate esters. The hydrocarbons such as paraffin and haloparaffin can be utilized in liquid form. It is also known to utilize waxy hydrocarbons, preferably having a melting point below 100° C. The hydrocarbons constitute a preferred category of suds suppressor for detergent compositions. Hydrocarbon suds suppressors are described, for example, in U.S. Pat. No. 4,265,779. The hydrocarbons, thus, include aliphatic, alicyclic, aromatic, and heterocyclic saturated or unsaturated hydrocarbons having from 12 to 70 carbon atoms. The term "paraffin," as used in this suds suppressor discussion, is intended to include mixtures of true paraffins and cyclic hydrocarbons.

Another preferred category of non-surfactant suds suppressors comprises silicone suds suppressors. This category includes the use of polyorganosiloxane oils, such as polydimethylsiloxane, dispersions or emulsions of polyorganosiloxane oils or resins, and combinations of polyorganosiloxane with silica particles wherein the polyorganosiloxane is chemisorbed or fused onto the silica. Silicone suds suppressors are well known in the art and are, for example, disclosed in U.S. Pat. No. 4,265,779 and EP 354016.

Other silicone suds suppressors are disclosed in U.S. Pat. No. 3,455,839 which relates to compositions and processes for defoaming aqueous solutions by incorporating therein small amounts of polydimethylsiloxane fluids.

Mixtures of silicone and silanated silica are described, for instance, in German Patent Application DOS 2,124,526. Silicone defoamers and suds controlling agents in granular detergent compositions are disclosed in U.S. Pat. No. 3,933, 672 and in U.S. Pat. No. 4,652,392.

An exemplary silicone based suds suppressor for use herein is a suds suppressing amount of a suds controlling agent consisting essentially of:

(i) polydimethylsiloxane fluid having a viscosity of from 20 cs. to 1,500 cs. at 25° C.;

(ii) from 5 to 50 parts per 100 parts by weight of (i) of siloxane resin composed of $(CH_3)_3SiO_{1/2}$ units of $SiO_2$ units in a ratio of from $(CH_3)_3$ $SiO_{1/2}$ units and to $SiO_2$ units of from 0.6:1 to 1.2:1; and (iii) from 1 to 20 parts per 100 parts by weight of (i) of a solid silica gel.

In the preferred silicone suds suppressor used herein, the solvent for a continuous phase is made up of certain polyethylene glycols or polyethylene-polypropylene glycol copolymers or mixtures thereof (preferred), or polypropylene glycol. The primary silicone suds suppressor is branched/crosslinked and preferably not linear.

The silicone suds suppressor herein preferably comprises polyethylene glycol and a copolymer of polyethylene glycol/polypropylene glycol, all having an average molecular weight of less than 1,000, preferably between 100 and 800. The polyethylene glycol and polyethylene/polypropylene copolymers herein have a solubility in water at room temperature of more than 2 weight %, preferably more than 5 weight %.

The preferred solvent herein is polyethylene glycol having an average molecular weight of less than 1,000, more preferably between 100 and 800, most preferably between 200 and 400, and a copolymer of polyethylene glycol/polypropylene glycol, preferably PPG 200/PEG 300. Preferred is a weight ratio of between 1:1 and 1:10, most preferably between 1:3 and 1:6, of polyethylene glycol:copolymer of polyethylene-polypropylene glycol.

The preferred silicone suds suppressors used herein do not contain polypropylene glycol, particularly of 4,000 molecular weight. They also preferably do not contain block copolymers of ethylene oxide and propylene oxide, like PLURONIC L101.

Other suds suppressors useful herein comprise the secondary alcohols (e.g., 2-alkyl alkanols) and mixtures of such alcohols with silicone oils, such as the silicones disclosed in U.S. Pat. Nos. 4,798,679, 4,075,118 and EP 150,872. The secondary alcohols include the $C_6$–$C_{16}$ alkyl alcohols having a $C_1$–$C_{16}$ chain. A preferred alcohol is 2-butyl octanol, which is available from Condea under the trademark ISOFOL 12. Mixtures of secondary alcohols are available under the trademark ISALCHEM 123 from Enichem. Mixed suds suppressors typically comprise mixtures of alcohol+silicone at a weight ratio of 1:5 to 5:1.

For any detergent compositions to be used in automatic laundry washing machines, suds should not form to the extent that they overflow the washing machine. Suds suppressors, when utilized, are preferably present in a "suds suppressing amount. By "suds suppressing amount" is meant that the formulator of the composition can select an amount of this suds controlling agent that will sufficiently control the suds to result in a low-sudsing laundry detergent for use in automatic laundry washing machines.

The compositions herein will generally comprise from 0% to 5% of suds suppressor. When utilized as suds suppressors, monocarboxylic fatty acids, and salts therein, will be present typically in amounts up to 5%, by weight, of the detergent composition. Preferably, from 0.5% to 3% of fatty monocarboxylate suds suppressor is utilized. Silicone suds suppressors are typically utilized in amounts up to 2.0%, by weight, of the detergent composition, although higher amounts may be used. This upper limit is practical in nature, due primarily to concern with keeping costs minimized and effectiveness of lower amounts for effectively controlling sudsing. Preferably from 0.01% to 1% of silicone suds suppressor is used, more preferably from 0.25% to 0.5%. As used herein, these weight percentage values include any silica that may be utilized in combination with polyorganosiloxane, as well as any adjunct materials that may be utilized. Monostearyl phosphate suds suppressors are generally utilized in amounts ranging from 0.1% to 2%, by weight, of the composition. Hydrocarbon suds suppressors are typically utilized in amounts ranging from 0.01% to 5.0%, although higher levels can be used. The alcohol suds suppressors are typically used at 0.2% –3% by weight of the finished compositions.

Fabric Softeners

Various through-the-wash fabric softeners, especially the impalpable smectite clays of U.S. Pat. No. 4,062,647, as well as other softener clays known in the art, can optionally be used typically at levels of from 0.5% to 10%, preferably from 0.5% to 2% by weight in the present compositions to provide fabric softener benefits concurrently with fabric cleaning. Clay softeners can be used in combination with amine and cationic softeners as disclosed, for example, in U.S. Pat. Nos. 4,375,41 6 and 4,291,071.

Other Ingredients

A wide variety of other functional ingredients useful in detergent compositions can be included in the compositions herein, including other active ingredients, carriers, hydrotropes, processing aids, dyes or pigments, solvents for liquid formulations, solid fillers for bar compositions. The detergent compositions herein will preferably be formulated such that, during use in aqueous cleaning operations, the wash water will have a pH of between 6.5 and 11, preferably between 7.5 and 10.5. Laundry products are typically at pH 9–11. Techniques for controlling pH at recommended usage levels include the use of buffers, alkalis, acids, etc., and are well known to those skilled in the art.

Other Optional Ingredients

Other optional ingredients suitable for inclusion in the compositions of the invention include colours and filler salts, with sodium sulfate being a preferred filler salt.

Form of the Compositions

The detergent compositions of the invention can be formulated in any desirable form such as powders, granulates, pastes, liquids, and gels.

Liquid Compositions

The detergent compositions of the present invention may be formulated as liquid detergent compositions. Such liquid detergent compositions typically comprise from 94% to 35% by weight, preferably from 90% to 40% by weight, most preferably from 80% to 50% by weight of a liquid carrier, e.g., water, preferably a mixture of water and organic solvent.

Gel Compositions

The detergent compositions of the present invention may also be in the form of gels. Such compositions are-typically formulated with polyakenyl polyether having a molecular weight of from 750,000 to 4,000,000.

Solid Compositions

The detergent compositions of the invention may also be in the form of solids, such as powders and granules.

Preferably, the mean particle size of the components of granular compositions in accordance with the invention should be such that no more that 5% of particles are greater than 1.4 mm in diameter and not more than 5% of particles are less than 0.15 mm in diameter.

The term mean particle size as defined herein is determined by sieving a sample of the composition into a number of fractions (typically 5 fractions) on a series of Tyler sieves. The weight fractions thereby obtained are plotted against the aperture size of the sieves. The mean particle size is taken to be the aperture size through which 50% by weight of the sample would pass.

The bulk density of granular detergent compositions in accordance with the present invention are particularly useful in concentrated granular detergent compositions that are characterised by a relatively high density in comparison with conventional laundry detergent compositions. Such high density compositions typically have a bulk density of at least 400 g/liter, more preferably from 650 g/liter to 1200 g/liter, most preferably from 800 g/liter to 1000 g/liter.

Making Processes—Granular Compositions

In general, granular detergent compositions in accordance with the present invention can be made via a variety of methods including dry mixing, spray drying, agglomeration and granulation.

The invention is illustrated in the following non limiting examples, in which all percentages are on a weight basis unless otherwise stated.

In the detergent compositions of the invention, the abbreviated component identifications have the following meanings:

XYAS : Sodium $C_{1X}$–$C_{1Y}$ alkyl sulfate

XYEZ : A ($C_{1x-1y}$ predominantly linear primary alcohol condensed with an average of Z moles of ethylene oxide XYEZS : $C_{1X}$–$C_{1Y}$ sodium alkyl sulphate condensed with an average of Z moles of ethylene oxide per mole TFAA : $C_{16}$–$C_{18}$ alkyl N-methyl glucamide NaSKS-6: Crystalline layered silicate of formula δ-$Na_2Si_2O_5$ Carbonate : Anhydrous sodium carbonate Silicate : Amorphous sodium silicate ($SiO_2$:$Na_2O$ MA/AA : Copolymer of 1:4 maleic/acrylic acid, average molecular weight about 80,000

Zeolite A : Hydrated Sodium Aluminosilicate of formula $Na_{12}(AlO_2SiO_2)_{12}.27H_2O$ having a primary particle size in the range from 1 to 10 micrometers Citric acid : Anhydrous Citric Acid Percarbonate : Anhydrous sodium percarbonate bleach of empirical formula $2Na_2CO_3.3H_2O_2$ coated with a mixed salt of formula $Na_2SO_4.n.Na_2CO_3$ where n is 0.29 and where the weight ratio of percarbonate to mixed salt is 39:1

TAED : Tetraacetyl ethylene diamine

DETPMP : Diethylenetriamine penta (Methylene phosphonic acid) marketed by Monsanto under the Trade name Dequest 2060.

EXAMPLE

The following perfume formulations were prepared

| Perfume 1 | % |
|---|---|
| Hexyl cinnamic aldehyde | 10 |
| Hexyl salicylate | 20 |
| Phenyl ethyl alcohol | 20 |
| Citronellol | 12 |
| Geraniol | 8 |
| 2-Methyl-3-(4-tertiary butyl phenyl) propanal | 10 |

-continued

| | |
|---|---|
| Phenyl ethyl acetate | 2 |
| Benzyl acetate | 5 |
| 4-tertiary butyl cyclohexyl acetate | 5 |
| 3-Buten-2-one, 4-(2,6,6-trimethyl-1-cyclohexen-1-yl) | 3 |
| 10-undecenal (10% in DPG) | 5 |

| Perfume 2 | % |
|---|---|
| Benzyl salicylate | 5 |
| Hexyl salicylate | 10 |
| Phenyl ethyl alcohol | 15 |
| 4-Iso propyl cyclohexanol | 5 |
| Citronellol | 10 |
| 3-Buten-2-one, 4-(2,6,6-trimethyl-1-cyclohexen-1-yl) | 15 |
| Heliotropine | 4 |
| 7-Acetyl, 1, 2, 3, 4, 5, 6, 7, 8-octahydro 1, 1, 6, 7 tetra methyl naphtalene | 5 |
| Benzyl acetate | 7 |
| 4-tertiary butyl cyclohexyl acetate | 20 |
| 2-Methyl-3-phenyl propan-2-yl acetate | 4 |

The following formulations A, B and C in accordance with the invention were prepared. Either of perfume 1 or perfume 2 formulations was used.

| Component (% by weight) | A | B | C |
|---|---|---|---|
| 25AS | 12 | 12 | 12 |
| 25E3S | 3 | 3 | 3 |
| 24E5 | 4 | 4 | 4 |
| TFAA | 8 | 8 | 8 |
| Zeolite A | 10.5 | 10.5 | 10.5 |
| NaSKS-6 | 8.5 | 8.5 | 8.5 |
| Citric Acid | 2.5 | 2.5 | 2.5 |
| Percarbonate | 17 | 17 | 17 |
| Carbonate | 13 | 13 | 13 |
| MA/AA | 2.5 | 2.5 | 2.5 |
| DETPMP | 1.6 | 0.95 | 0.95 |
| HEDP | — | 0.65 | 0.65 |
| TAED | — | — | 2.3 |
| 6 (-nonanamidocaproyl) oxybenzene sulphonate | 6.0 | 6.0 | 4.7 |
| Perfume (*) | 0.5 | 0.5 | 0.5 |
| Minors to balance | | | |

(*)-perfume composition as defined above

What is claimed is:

1. A laundry detergent composition comprising:

a) a hydrophobic bleaching system selected from the group consisting of:

i) hydrogen peroxide or a source thereof in an amount of form 0.1% to 60% by weight and combined with a hydrophobic peroxyacid bleach precursor in an amount of form 0.01% to 60% by weight, ii) a preformed hydrophobic peroxyacid in an amount of form 0.1% to 60% by weight wherein the preformed hydrophobic peroxyacid is selected from the group consisting of: (6-octylamino)-6-oxo-caproic acid, (6-nonylamino)-6-oxo-caproic acid, (6-decylamino)-6-oxo-caproic acid, magnesium monoperoxyphthalate hexahydrate, the magnesium salt of metachloro perbenzoic acid, 4-nonylamino-4-oxoperoxybutyric acid and mixtures thereof, and iii) mixtures of i) and ii), wherein said hydrophobic peroxyacid bleach precursor produces under perhydrolysis a hydrophobic peroxyacid whose parent carboxylic acid has a critical micelle concentration less then 0.5 moles/liter measured in aqueous solution at 25° C. and pH 7, b) from 0.01% to 5% by weight of a perfume composition, wherein said perfume composition comprises aroma chemicals selected from the group consisting of primary alcohols, secondary alcohols, aliphatic aldehydes, hydrocinnamic aldehydes, esters excluding salicylates, unsaturated ketones, and mixtures thereof, c) at least 0.6% by weight of a metal ion sequesterant selected from the group consisting of: aminocarboxylate compounds, aminophosphonate compounds and mixtures thereof, d) from 0.1% to 20% by weight of an organo diphosphonic acid crystal growth inhibitor or its salts or complexes, and e) a detergent adjunct material comprising one or more of the following:

i) from 0.01 to 10% by weight of the composition of a dye transfer inhibiting agent; and ii) from 0.5% to 10% by weight of the composition of a fabric softener.

2. A detergent composition according to claim 1, wherein the backbone chain of the peroxyacid bleach precursor contains more than 7 carbons.

3. A detergent composition according to claim 2, wherein said hydrophobic bleach precursor is selected from bleach precursor compounds which comprise at least one acyl group forming the peroxyacid moiety bonded to a leaving group through an —O— or —N— linkage.

4. A detergent composition according to claim 3, wherein said bleach precursor is selected from the group consisting of amide substituted peroxyacid precursor compounds and any mixtures thereof.

5. A detergent composition according to claim 4, wherein said bleach precursor is selected from the group consisting of (6-octanamido-caproyl)oxybenzene sulfonate, (6-nonanamidocaproyl) oxybenzene sulfonate, (6-decanamido-caproyl)oxybenzene sulfonate, and mixtures thereof.

6. A detergent composition according to claim 1, wherein the total sum of the weight of said aroma chemicals in the perfume is at least about 30% by weight of the perfume.

7. A detergent composition according to claim 1, wherein said aminocarboxylate compounds are selected from the group consisting of ethylenediamine-N,N'-disuccinic acid, ethylenediamine tetraacetic acid, N-hydroxyethylenediamine triacetic acid, nitrilotriacetic acid, ethylene diamine tetrapropionic acid, ethylenediamine-N,N'-diglutamic acid, 2-hydroxypropylenediamine-N,N'-disuccinic acid, triethylenetetraamine hexacetic acid, diethylenetriamine pentaacetic acid, trans 1,2 diaminocyclohexane-N,N,N',N'-tetraacetic acid, ethanoldiglycine and mixtures thereof.

8. A detergent composition according to claim 7 wherein said aminocarboxylate compound is ethylenediamine-N,N'-disuccinic acid.

9. A detergent composition according to claim 1, wherein said aminophosphonate compounds are selected from the group consisting of diethylene triamine penta (methylene phosphonate) and hexamethylene diamine tetra (methylene phosphonate) and mixture thereof.

10. A detergent composition according to claim 1, wherein said crystal growth inhibitor is selected from the group consisting of ethylene diphosphonic acid, α-hydroxy-2 phenyl ethyl diphosphonic acid, methylene diphosphonic acid, vinylidene 1,1 diphosphonic acid, 1,2 dihydroxyethane 1,1 diphosphonic acid and hydroxy-ethane 1,1 diphosphonic acid and any salts thereof and mixtures thereof.

11. A detergent composition according to claim 10, wherein said crystal growth inhibitor is hydroxy-ethane 1,1 diphosphonic acid.

12. A detergent composition according to claim 1, wherein said composition further comprises one or more surfactants present in a total amount of at least about 11% by weight of the detergent composition.

13. A detergent composition according to claim 12, wherein said composition further comprises one or more surfactants present in a total amount of at least about 20% by weight of the detergent composition.

14. A detergent composition according to claim 13, wherein at least one of said surfactants is an anionic surfactant.

15. A detergent composition according to claim 1, wherein said composition further comprises a co-precursor selected from the group consisting of cationic bleach precursors, hydrophilic bleach precursors and mixtures thereof.

16. A detergent composition according to claim 15 wherein said co-precursor is a hydrophilic bleach precursor.

17. A detergent composition according to claim 16, wherein said hydrophilic bleach precursor is tetraacetyl ethylene diamine bleach precursor.

* * * * *